United States Patent [19]

Yamaguchi et al.

[11] Patent Number: 4,537,645

[45] Date of Patent: Aug. 27, 1985

[54] MAGNETICALLY TRACEABLE EXPLOSIVES WITH STABILITY AND A METHOD FOR THE PREPARATION THEREOF

[75] Inventors: Tadashi Yamaguchi; Takayuki Ono; Michitoshi Hirata; Toshihiko Yokoyama, all of Sendai, Japan

[73] Assignees: Tohoku Metal Industries, Ltd., Senadi; Taisei Corporation, Tokyo, both of Japan

[21] Appl. No.: 565,571

[22] Filed: Dec. 27, 1983

Related U.S. Application Data

[62] Division of Ser. No. 315,136, Oct. 26, 1981, Pat. No. 4,455,179.

[51] Int. Cl.[3] ..... C06B 45/18

[52] U.S. Cl. ..... 149/3; 149/46; 149/76; 149/88; 149/96; 149/101; 149/123; 252/62.54; 252/62.56

[58] Field of Search ..... 102/293; 149/2, 3, 46, 149/88, 96, 100, 109.6, 123; 252/62.54, 62.56; 264/3 C

[56] References Cited

U.S. PATENT DOCUMENTS

| | | | |
|---|---|---|---|
| 3,737,349 | 6/1973 | Levenson | 149/123 |
| 4,120,806 | 10/1978 | Watanabe et al. | 252/62.54 |
| 4,198,307 | 4/1980 | Berkowitz | 149/2 X |
| 4,222,330 | 9/1980 | Krystyniak | 149/2 X |
| 4,282,302 | 8/1981 | Makino et al. | 252/62.54 X |
| 4,363,678 | 12/1982 | Nishimura et al. | 264/3 C X |

*Primary Examiner*—Stephen J. Lechert, Jr.
*Attorney, Agent, or Firm*—Brisebois & Kruger

[57] ABSTRACT

The invention provides a novel magnetically traceable or detectable explosive blended with a magnetic ferrite powder which facilitates the detection of the misfired explosive, e.g. dynamite, remaining in the field after blasting by a magnetic means but not to adversely affect the stability of the explosive. The ferrite powder is freed of any free alkalinity on the surface before blending with the explosive either by washing with water, neutralization with a dilute acid, reaction with an acid followed by washing with water or neutralization with an alkali and/or by coating with a polymeric material on the particles. The most efficient method for the coating of the ferrite powder with a polymeric material is the in situ polymerization of a radical-polymerizable monomer in contact with the ferrite particles in the presence of hydrogensulfite ions and the explosives blended with such a polymer-coated ferrite powder retain their stability even after a prolonged storage.

5 Claims, No Drawings

MAGNETICALLY TRACEABLE EXPLOSIVES WITH STABILITY AND A METHOD FOR THE PREPARATION THEREOF

This is a division of application Ser. No. 315,136, filed Oct. 26, 1981, now U.S. Pat. No. 4,455,179.

BACKGROUND OF THE INVENTION

The present invention relates to a magnetically traceable blasting explosive with stability and a method for the preparation thereof. More particularly, the subject matter of the present invention is a blasting explosive based on a nitrate and nitric ester compound such as ammonium nitrate, nitroglycerin, nitrocellulose and nitroglycol, e.g. dynamite, as well as a chlorate and perchlorate, e.g. ammonium perchlorate, both in the solid and slurried forms, which is magnetically traceable or detectable by virtue of a magnetic powdery material incorporated therein but still has the same degree of stability as the explosive per se without the magnetic material.

Needless to say, explosives of nitrated compounds such as ammonium nitrate, nitroglycerin, nitrocellulose, nitroglycol and the like in the form of, for example, dynamites and explosives of (per)chlorate compounds constitute the main current of the industrial explosives used in mining, civil engineering and the like. One of the very serious problems in the use of industrial explosives, e.g. dynamites, for blasting of soils and rocks is that, when the blasting is performed at several locations with several dynamites in one time, one or more of the dynamites sometimes remain misfired. Such an unexploded dynamite remaining in the field after blasting may be exploded accidentally, when the blasting work is continued with the unexploded dynamites unremoved as embedded in the soil or rock, by the mechanical shock when contacted with a drill tip under working of the excavation or drilling of the soil or rock to prepare for the next blasting. Therefore, it is imperative in the blasting work by use of dynamites or other explosives to quickly and efficiently detect the unexploded ones before continuing the blasting work since otherwise big disastrous damages on man power are sometimes unavoidable.

The most simple means for detecting such unexploded dynamites is the search with naked eyes although such a method is undesirable not only due to the incomplete detection of the unexploded dynamites but also due to the great labor and danger inevitably accompanying such a work. Accordingly, there have been proposed several methods without the aid of the naked eyes of the workers for the detection of the unexploded dynamites in the field.

Furthermore, another serious problem with respect to an explosive is the detection or search of a malignantly possessed or illegally hidden explosive. For example, explosives stolen and hidden by burglars must be searched by policemen with much labor and time and it is common that passengers are searched before riding an airplane for illegally carried weapons in order to prevent hijacking while the methods used in the airports are powerless to detect non-metallic dangerous articles such as explosives so that development of efficient methods for explosive detection is eagerly desired also in this point.

One of the promising approaches for the safe and efficient detection of an explosive, e.g. dynamite, is the use of a magnetic material. That is to say, each of, for example, dynamites is kept or used as integrally combined with a magnetic material or, in particular, with a magnetic powdery material incorporated thereinto followed by magnetization so as to be easily detected by a magnetic sensor means even in a hidden or covered state. For example, a number of such magnetic explosives are set at the blasting points and, if one or more of the explosives remain misfired after blasting as covered with rocks and sand, the locations of the unexploded explosives can readily be indicated by the magnetic sensor means. A magnetic sensor means installed in an airport can easily point out a hijacker illegally carrying an explosive when the explosive is admixed with a magnetic powdery material and magnetized.

Suitable magnetic materials for such a purpose are of course not limited to any particular types provided that the material is magnetically hard or, in other words, the material has a sufficiently large residual magnetization or coercive force in order to facilitate the detection by a magnetic sensor means. Practically speaking, however, most of the magnetically traceable explosives are impregnated with a magnetic ferrite in a finely pulverized form because of the sufficiently high magnetic performance in addition to the availability with outstanding inexpensiveness in comparison with other types of magnetic materials.

Ferrite magnetics are, however, not quite free from practical problems. One of the serious problems in the use of powders of ferrite magnetics as incorporated in an explosive is that the stability of the explosive is greatly reduced when the explosive compound is in contact with the ferrite powder. In an experiment undertaken by the inventors with dynamites, for example, the time up to the detection of the nitrogen dioxide in the Abel's heat test, which should be compulsorily undertaken as a means for the evaluation of the stability of explosives as specified in the regulation for the Explosive Control Act, was decreased to about one fourth or less when the explosive was admixed with a powdery ferrite in comparison with the same explosive without the ferrite powder. The time will be further shortened when a ferrite-blended explosive is stored over a certain period before its use for blasting. Therefore, the advantages of the magnetic explosives admixed with a ferrite powder is greatly reduced by the increased danger caused by the decomposition during storage against the intention of the use of magnetic explosives.

SUMMARY OF THE INVENTION

It is therefore an object of the present invention to provite a novel and improved magnetic explosive or magnetically traceable or detectable explosive which is incorporated with a powdery ferrite magnetic material but still has a stability as high as the explosives without the ferrite powder not only as prepared but also after prolonged storage before the use for blasting.

Another object of the invention is to provide a method for the preparation of such an improved magnetically traceable explosive.

The principle of the present invention is that the ferrite powder incorporated in the explosive should be imparted with a neutral condition on the surface to such a extent that, when the ferrite powder is suspended in water, the pH value of the water is in the range from 5.0 to 9.0.

The most simple way for realizing the above mentioned neutral surface condition of the ferrite powder is to wash the ferrite powder with water before blending of the ferrite powder with the explosive such that any free alkaline material inherently contained in the ferrite has been leached out.

Although washing of the ferrite powder with water is sufficiently effective to remove the alkaline material from the very superficial layer of the ferrite particles, removal of the alkaline material may be accelerated or more complete when the ferrite powder is washed with a dilute acid having a pH of 4.0 or lower so that the effect of stabilization is more durable than by washing with mere water.

A further effective method for keeping the ferrite powder in a neutral surface condition is to coat the surface of the ferrite powder with a polymeric material in order to prevent the migration or release of the alkaline material out of the surface followed by washing with water as mentioned above. It is of course that best results are obtained when the above mentioned coating with a polymeric material is performed with a ferrite powder which has been washed in advance with water or a dilute acid so as to free the surface of the ferrite powder from free alkaline materials before coating with a polymeric material.

Further improvement in the inventive magnetic explosive is achieved when coating of the ferrite powder with a polymeric material is carried out by the in situ polymerization of a monomer polymerizable by the free radical mechanism on the surface of the ferrite powder in the presence of hydrogensulfite ions whereby the polymer film is bonded to the surface of the ferrite particles with increased adhesive strengths.

DETAILED DESCRIPTION OF THE PREFERRED EMBODIMENTS

With the object mentioned above, the inventors have initiated their investigation first to discover the reason for the instabilization of the explosives blended with a ferrite powder. The conclusion arrived at in the investigation is that the free alkaline materials contained more or less in conventional magnetic ferrites are responsible for the instabilization of the explosives since an alkaline material accelerates the decomposition reaction of the components in the explosives such as ammonium nitrate, nitroglycerin, nitroglycol, nitrocellulose, ammonium perchlorate and the like.

Mangetic ferrites belong to a class of composite oxides and are in general composed of an iron oxide and one or more of the other oxides of alkali metals, e.g. lithium, and alkaline earth materials, e.g. calcium, strontium and barium. They are usually prepared by calcining a powdery mixture of hydroxides or other compounds readily decomposed and converted to oxides of the respective elements so that it is not surprising that any ferrite materials contain considerable amounts of free oxides of the alkali or alkaline earth metals not combined with the iron oxide constituent.

Accordingly, it follows that the magnetic ferrite powder is desirably freed from any free alkaline materials as completely as possible before it is blended with an explosive. The inventors' efforts directed to the establishment of a simple and convenient method for the complete removal of the free alkaline materials from the particle surface of a ferrite powder unexpectedly resulted in a discovery that the most simple but effective method is to wash the ferrite powder whereby the free alkaline materials are leached out of the ferrite surface.

That is, when particles of the magnetic ferrite are suspended in water, the free alkaline materials contained in the surface layer of the particle are readily leached out of the surface into the water while the velocity of migration of the free alkaline materials contained in the core portion of the particle in an amount of a substantial percentages, though dependent on the particle size, of the overall free alkaline materials is very low toward the surface of the particle so that mere washing of the ferrite powder with water or neutralization with a dilute acid solution is practically sufficient not to adversely affect the stability of the explosive incorporated therewith even though such a mere washing or neutralization is effective only to leach out the alkaline materials in the surface layer of the ferrite particles.

Further investigations of washing of the ferrite powder established a critical condition of washing that the value of pH of water in which thus washed ferrite particles are suspended should be in the range from 5.0 to 9.0 when the pH is determined at room temperature with a suspension of the ferrite powder in four times by weight of water in order to minimize the adverse effects of the ferrite powder on the stability of the explosives blended therewith.

The magnetic ferrite materials suitable for blending in an explosive according to the invention include several types such as soft magnetic ferrites having a crystalline structure of spinel exemplified by manganese-zinc ferrites, nickel-zinc ferrites and the like, semi-hard magnetic ferrites exemplified by lithium ferrites, manganese-magnesium ferrites and the like and hard magnetic ferrites having a crystalline structure of magnetoplumbite exemplified by those represented by a general formula $MO.6Fe_2O_3$, in which M is a divalent cation of a metal such as calcium, barium, strontium and lead. The hard magnetic ferrites having a large coercive force are preferred in view of the easiness in the detection of them remaining in the unexploded explosive with a magnetic sensor. The ferrite powder has desirably a particle diameter of 10 $\mu$m or smaller to facilitate the magnetic detection after blasting as well as to reduce the abrasive wearing of the blending machine in the mixing of the ferrite powder with the explosive. This particle size limitation is also significant in that the ferrite particles contained in an explosive and scattered by the explosion of the explosive are rapidly demagnetized by the heat of explosion to such an extent that the detection of the unexploded explosive by use of a magnetic sensor is not disturbed by the ferrite particles insufficiently demagnetized and scattered therearound.

As is mentioned before, washing of the ferrite powder may be carried out either with water or with a dilute acid solution to neutralize the free alkaline materials in the ferrite powder. The acid suitable for the neutralization is not limited to particular ones but may be any one of conventional inorganic and organic acids such as sulfuric, hydrochloric, sulfurous, phosphoric, acetic and propionic acids. Inorganic acids are preferred when the problem of sewage disposal is taken into consideration.

Regardless of whether removal of the alkaline material is performed by washing of the ferrite powder with water or by neutralization with a dilute acid solution added to the aqueous suspension, washing or neutralization must be continued until the pH value of the aqueous suspension of the ferrite powder in four times by weight of water is in the range from 5.0 to 9.0 or, preferably, from 6.0 to 8.0 at room temperature. Therefore, when a dilute acid solution is used for neutralization, any excessive amount of the acid should be removed by subsequent washing with water so that the surface of the ferrite particles is not unduly acidic. It is sometimes preferable that the aqueous suspension containing the ferrite powder for washing or neutralization is heated in order to accelerate removal of the alkaline materials.

The ferrite powder washed as described above and having a neutral surface condition is then thoroughly dried and incorporated into an explosive in an amount of a few % to 20% by weight. The explosives admixed with the ferrite powder in a neutral condition have a stability of about the same degree as in the explosive without the magnetic powder. For example, the dynamites prepared as described above satisfy the safety standard with the time to the detection of nitrogen dioxide of 30 minutes or longer in the Abel's heat test as specified in the regulations.

The magnetic explosive prepared with the washed or neutralized ferrite powder according to the above description is sufficiently stable by the test for stability at least as prepared. There has arisen a problem, however, that storage of the magnetic explosive over a period of several months or longer may decrease the stability of the explosive. This is presumably because the once neutralized surface of the ferrite particles gradually resumes the alkalinity with the elapse of time due to the migration of the free alkaline materials contained in the core portion of the particles toward the surface. This problem again drove the inventors to further investigations to obtain a lastingly stable magnetic explosive.

The investigations undertaken by the inventors have led to a solution of the above problem, according to which more lasting effect of stabilizing the explosive is obtained when the ferrite powder to be blended with the explosive is treated with an acid for a sufficient time such that the acid suspension containing the ferrite powder has a pH of 4.0 or below before washing to neutral.

The acid used in this acid treatment may be inorganic or organic among those named above for the neutralization. The pH of the acid suspension should be 4.0 or below since, needless to say, a higher pH gives no sufficient effect of the acid treatment while it should be noted that an excessively high concentration of the acid is undesirable because of the decomposing effect on the ferrite powder resulting in decreased magnetic properties of the ferrite. The acid treatment is carried out preferably at an elevated temperature of the acid suspension in order to accelerate the reaction. After the end of the acid treatment, the ferrite powder is washed with water or neutralized with a dilute alkali to be imparted with neutrality followed by drying.

The explosive blended with the thus acid-treated ferrite powder remains stable during prolonged storage of over several months or longer as evaluated by the Abel's heat test.

Further investigations conducted for the improvement of the durability of the stability of the ferrite-blended explosives led to a conclusion that the most effective way for the purpose is to prevent the surface of the ferrite particles from direct contact with the explosive by coating the surface with an inert material in addition to the removal of the alkaline materials at or near the surface of the ferrite particles.

The inert material for coating of the ferrite particles should of course be polymeric in view of the physical and chemical properties suitable for blending with the explosives.

Needless to say, coating of a ferrite powder with a polymeric material may be carried out in a variety of methods. For example, dipping of the ferrite powder in a solution of a polymer followed by drying may give polymer-coated ferrite particles. It has been found, however, that the best results are obtained by the in situ polymerization of a monomer on the surface of the ferrite particles. The principle and the basic procedure of this in situ polymerization of a monomer on the surface of ferrite particles are described, for example, in U.S. Pat. No. 3,916,038.

In the method, a monomer polymerizable by the mechanism of free radical polymerization is brought into contact with the surface of the ferrite particles in the presence of hydrogensulfite ions $HSO_3^-$ whereby the monomer is polymerized on the surface to form a coating film of the polymer on the particle. The thus polymer-coated ferrite powder is then washed with water to ensure neutrality of the surface. Further, it is desirable that the ferrite powder is washed with water or neutralized with a dilute acid solution in the above described manner in advance of the in situ polymerization of the monomer so as to ensure neutrality of the surface of the ferrite particles to be brought into contact with the monomer to such an extent that the value of pH of the water in which the ferrite particles are suspended is in the range from 5.0 to 9.0.

The monomers polymerizable by the mechanism of free radical polymerization and suitable for the above mentioned in situ polymerization are exemplified by acrylic and methacrylic acids as well as esters thereof such as methyl acrylate, butyl acrylate, ethyleneglycol diacrylate, methyl methacrylate, ethyl methacrylate, ethyleneglycol dimethacrylate, 2-hydroxyethyl methacrylate and the like, vinyl esters of aliphatic carboxylic acids such as vinyl acetate, vinyl propionate and the like, aromatic vinyl compounds such as styrene, α-methylstyrene and the like and dienic monomers such as butadiene, isoprene, chloroprene and the like as well as acrylonitrile, methacrylonitrile, acrylamide and methacrylamide. These monomers may be used either alone or as a combination of two kinds or more such that the resulting coating films are formed of the copolymer thereof.

The amount of the monomer or monomers to be brought into contact with the ferrite powder is determined in consideration of the economy in view of the expensiveness of the monomers and the completeness of the coating film formed on the ferrite particles. Usually, it is in the range from 0.1 to 30% by weight or, preferably, from 0.5 to 10% by weight based on the ferrite powder. Larger amounts of the monomers than above are economically disadvantageous while the ferrite particles are coated incompletely with a smaller amount of the monomer.

The hydrogensulfite ions to be present in the mixture under polymerization are supplied by adding aqueous sulfurous acid, sulfur dioxide gas, aqueous sulfite solution, aqueous hydrogensulfite solution and the like to the aqueous suspension of the monomer and the ferrite powder. The amount of hydrogen-sulfite ion-supplying material is in the range from 0.01 to 30 parts by weight or, preferably, from 0.5 to 10 parts by weight calculated as sulfurous acid per 100 parts by weight of the monomer or monomers.

The coating process by the above mentioned in situ polymerization is carried out in a manner as follows. Thus, 1 part by weight of the ferrite powder, preferably, in a neutral condition in advance on the surface by the pre-treatment is suspended in 1 to 10 parts by weight of water and the monomer or monomers and the hydrogensulfite ion-supplying agent are added to the suspension in amounts as defined above. The polymerization reaction proceeds at a temperature in the range from 10° to 100° C. or, preferably, from 20° to 70° C. and almost 100% of the monomer is converted to the polymer within 1 to 4 hours. Needless to say, a diversity of modifications and variations are possible in the above described conditions for the in situ polymerization.

The ferrite powder after completion of the in situ polymerization as above naturally contains or is contaminated with an acidic substance which may be the sulfurous acid or sulfuric acid as an oxidation product thereof as well as a derivative of a sulfonic acid produced by the reaction of the sulfurous acid or sulfuric acid with the monomer or the active oligomeric species under growing. These acidic substances are detrimental to the stability of the explosive accelerating the decomposition of it. Accordingly, such an acidic substance should be removed by washing with water or by neutralizing with a dilute alkali so that the neutrality of the ferrite powder on the surface is ensured to give a pH of 5.0 to 9.0 to the water in which the polymer-coated ferrite powder is suspended.

When neutralization of the acidic substance is undertaken with an alkali, a dilute aqueous solution of sodium hydroxide, potassium hydroxide, sodium carbonate and the like as well as a dilute ammonia water may be used though not limited thereto. It is preferable that the alkali-neutralized, polymer-coated ferrite powder is further washed with water to remove any trace amount of the alkaline and other water-soluble materials and to bring the surface of the coated ferrite particles to an electrolyte-free condition. That is, final washing with water is repeated until the washing water has a pH of 5.0 to 9.0 or, preferably, 6.0 to 8.0.

The polymer-coated ferrite powder thus obtained is then thoroughly dried and, when it is in a caked state, disintegrated into individual particles before incorporation into an explosive in a suitable manner.

The explosives to which the method of the invention is applicable include three classes according to the chemical compounds having a problem of instabilization when blended with a ferrite powder not treated according to the invention. The explosives of the first class are the nitric ester-based ones such as nitroglycerin, nitroglycol and the like typically exemplified by dynamites. The second class explosives are the chlorate- or perchlorate-based ones such as ammonium perchlorate and the third class explosives are the nitrate-based ones such as ammonium nitrate and the like including so-called ANFO-type explosives in a slurried or gelled state.

The magnetic explosives blended with the polymer-coated ferrite powder obtained in the above described manner are very stable by the test for stability not only as prepared but also after prolonged storage for 6 months or longer to satisfy the standard specified in accordance with the particular type of the explosives. For example, a magnetic dynamite prepared in the above described manner with a ferrite powder satisfies the stability standard in the Abel's test at 72° C. giving a time to the detection of nitrogen dioxide of 30 minutes or longer when 10% by weight of the ferrite powder is blended with the explosive and stored over a period of 6 months. This lasting stability of the ferrite-impregnated explosive is very surprising and unexpected when compared with a similar dyanmite blended with the same amount of an untreated ferrite powder which gives the time to the detection of nitrogen dioxide of only 7 minutes by the Abel's heat test at 72° C. immediately after blending with further decreasing trend during storage.

The above mentioned Abel's heat test is a very sensitive method as a measure for the estimation of the stability of a dynamite against decomposition. For example, the time to the detection of nitrogen dioxide is noticeably decreased even by the presence of a trace amount of an acidic or alkaline material in the explosive inducing the decomposition of the nitro groups or the nitric ester groups in the explosive. Therefore, the result of testing to satisfy the Abel's heat test on one hand is an evidence for the complete absence of any impurities responsible for the decomposition or degradation of the polymeric material in the coating films on the other hand. Accordingly, the stability of the inventive magnetic explosive should be ensured over a much longer period of storage than in the storage test of up to 6 months described in the following examples given to illustrate the present invention in further detail but not to limit the scope of the invention in any way.

Meanwhile, the blasting performance of the explosive, e.g. dynamite, is little affected by the incorporation of the ferrite powder provided that the amount of the ferrite is not excessively large. In an example, a dynamite was blended with 10% by weight of a barium ferrite powder treated in accordance with the inventive method and magnetized by use of a condenser magnetizer capable of giving a magnetic field of 18,000 Oe maximum. Measurement of the detonation velocity was undertaken according to the procedure specified in JIS with the dynamite as such and the dynamite blended with the ferrite and magnetized to give values of 5,800 m/sec. for the former and 5,540 m/sec. for the latter.

EXAMPLE 1

Into a three-necked flask of 1 liter capacity equipped with a stirrer, a thermometer and a condenser were introduced 500 g of water and 100 g of a barium ferrtie powder having an average particle diameter of about 1 μm and the suspension was heated to boiling where agitation was continued for 1 hour followed by cooling to room temperature. The suspension had a pH of 11.3.

The suspension was neutralized to a pH of 7.0 by adding a small volume of a 1N hydrochloric acid. When kept standing, the pH of this once neutralized suspension gradually increased reaching 8.5 after 30 minutes where the pH levelled off with very small increase by further standing.

The suspension was further neutralized with the 1N hydrochloric acid to a pH of 7.0 and filtered to be separated into the aqueous solution and the ferrite powder, which was washed twice each time with 200 g of water and thoroughly dried in a vacuum desiccator. The yield was 99.3 g.

An Abel's heat test was undertaken at 72° C. with a dynamite prepared by uniformly blending 10 g of the thus treated barium ferrite powder with 100 g of a dynamite of the grade Enoki #2 to estimate the stability of the magnetically traceable dynamite. The time to the detection of nitrogen dioxide gas as a decomposition product of the dynamite was 30 minutes or longer which was the same as in the standard product of the dynamite of the same grade.

For comparison, the same Abel's heat test was undertaken for a dynamite blended with 10 g of the same but untreated barium ferrite. The time to the detection of the nitrogen dioxide gas was only 7 minutes to indicate the very undesirable effect of instabilization caused by the ferrite powder.

EXAMPLE 2

The same experimental procedure as in Example 1 was repeated except that the hydrochloric acid used for neutralization was replaced with a 1N sulfuric acid. The yield of the thus neutralized, washed and dried ferrite powder was 99.6 g.

The Abel's heat test undertaken with a dynamite blended with the above treated barium ferrite powder in the same manner as in Example 1 gave the time to the detection of nitrogen dioxide of 30 minutes or longer.

EXAMPLE 3

The experimental procedure was the same as in Example 1 except that the barium ferrite was replaced with 100 g of a strontium ferrite powder having an average particle diameter of about 2 μm. The yield of the thus neutralized, washed and dried ferrite powder was 99.5 g.

The Abel's heat test undertaken with a dynamite blended with the above treated strontium ferrite powder in the same manner as in Example 1 gave the time to the detection of nitrogen dioxide of 30 minutes or longer.

EXAMPLE 4

In the same apparatus as used in Example 1 were suspended 100 g of a barrium ferrite powder having an average particle diameter of about 1 μm in 500 g of water and the suspension was heated to boiling where agitation was continued for 1 hour followed by cooling to room temperature. The suspension had a pH of 11.5.

The suspension was filtered and the ferrite powder was washed five times each time with 200 g of water. The washing water from the fifth washing had a pH of 8.8. The barium ferrite powder was thoroughly dried in a vacuum desiccator. The yield of the thus dried ferrite powder was 99.6 g.

The Abel's heat test was undertaken in the same manner as in Example 1 to give the time to the detection of nitrogen dioxide of 30 minutes or longer.

EXAMPLE 5

In the same flask as used in Example 1 were introduced 100 g of the same barium ferrite as in Example 1 and 500 g of water with addition of 20 ml of a 1N hydrochloric acid and the suspension was agitated for 30 minutes at an elevated temperature. The suspension had a pH of 1.6 after cooling to room temperature.

The acidic aqueous suspension was neutralized by adding a small volume of a 1N aqueous solution of sodium hydroxide to a pH of 7.0. When kept standing, the pH of the thus neutralized aqueous suspension gradually decreased reaching 5.5 after 30 minutes where the pH was levelled off with very small further decrease even by prolonged standing.

The thus weakly acidified aqueous suspension was again neutralized by adding a small volume of the alkali solution to a pH of 7.0 and then filtered. The ferrite powder was washed twice each time with 200 g of water followed by drying in a vacuum desiccator. The yield was 98.5 g.

The Abel's heat test undertaken in the same manner as in Example 1 at 72° C. with the thus treated ferrite powder gave a time to the detection of nitrogen dioxide gas of 30 minutes or longer directly after blending of the ferrite powder with the dynamite while the time was substantially unchanged after 3 months of storage of the ferrite-blended dynamite.

EXAMPLE 6

The experimental procedure was just the same as in Example 5 above except that a 1N sulfuric acid was used in place of the 1N hydrochloric acid. The yield of the acid-treated ferrite powder was 99.6 g.

The results of the Abel's heat test undertaken with the dynamite blended with the thus treated ferrite powder were the same as in Example 5 both directly after blending of the ferrite powder with the dynamite and after 3 months of storage of the ferrite-blended dynamite.

EXAMPLE 7

The experimental procedure was just the same as in Example 5 except that the same strontium ferrite powder as in Example 3 was treated instead of the barium ferrite. The yield of the acid-treated ferrite powder was 98.7 g.

The results of the Abel's heat test undertaken with the dynamite blended with the thus acid-treated strontium ferrite in the same manner as in Example 5 were as good as in Example 5 both directly after blending of the ferrite powder and after 3 months of storage of the dynamite.

EXAMPLE 8

An aqueous suspension of 100 g of the same barium ferrite powder as in Example 1 in 500 g of water was heated to boiling in the same flask as used in Example 1 and agitated for 1 hour with continued boiling. Then, 50 ml of a 1N hydrochloric acid were added to the suspension and agitation was further continued for additional 30 minutes. The suspension had a pH not exceeding 1 after cooling to room temperature.

The suspension was filtered with suction and the ferrite powder was washed 10 times each time with 200 g of water. The washing water from the last washing had a pH of 5.6. The ferrite powder was thoroughly dried in a vacuum desiccator. The yield of the thus treated and dried ferrite powder was 98.3 g.

The Abel's heat test undertaken with the dynamite blended with the thus treated ferrite powder in the same manner as in Example 5 gave the time to the detection of the nitrogen dioxide gas of 30 minutes or longer both directly after blending of the ferrite powder and after 3 months of storage.

EXAMPLE 9

Into a flask of 1 liter capacity equipped with a stirrer and a thermometer were introduced 100 g of the same barium ferrite powder as used in Example 1, 20 g of a polymer of methyl acrylate and 500 g of benzene to dissolve the polymer and the mixture was agitated for 10 minutes at room temperature. The benzene solution was removed by filtration and the wet cake of the barium ferrite was dried and disintegrated into powder. The weight increase of the thus treated ferrite powder was about 2.0% indicating coating of the ferrite particles with the polymer.

The polymer-coated ferrite powder was blended with dynamite in the same manner as in Example 1 and the Abel's heat test undertaken with this dynamite gave the time to the detection of nitrogen dioxide of 30 minutes or longer.

EXAMPLE 10

Into a suspension of 100 g of a barium ferrite having an average particle diameter of about 1 μm in 500 g of water kept at 60° C. were added 7 g of methyl methacrylate monomer and 40 g of a 6% aqueous sulfurous acid and the mixture was vigorously agitated for 2 hours at 60° C. The value of pH of the reaction mixture after cooling was 2.8.

A half portion of the thus obtained slurried mixture was filtered as such and the wet cake of the barium ferrite powder was dried. This powder is called the unneutralized ferrite.

The other half portion of the suspension after the reaction was neutralized to a pH of 7.0 by adding a small volume of a 0.1N aqueous solution of sodium hydroxide and filtered and the ferrite powder was dried. This powder is called the neutralized ferrite.

The content of the polymeric matter in both of the unneutralized and neutralized ferrites was 6.0 g per 100 g of the ferrite.

Each of the dried ferrites was ground and disintegrated with a mortar and a pestle and used as a magnetic powder for blending in an explosive. The testing procedure for the stability of the dynamite blended with the ferrite powder was the same as in Example 1 and the times to the detection of nitrogen dioxide were 30 minutes or longer and 22 minutes for the neutralized and unneutralized ferrites, respectively.

The time to the nitrogen dioxide detection after one month of storage decreased somewhat even in the dynamite blended with the neutralized ferrite but the decrease was by far more remarkable in the dynamite blended with the unneutralized ferrite.

EXAMPLE 11

Into the same reaction vessel as used in Example 10 were introduced 100 g of a barium ferrite powder having an average particle diameter of about 1 μm and 500 g of water and the suspension was vigorously agitated for about 30 minutes at 80° C. The pH value of the suspension was 11.0. A small volume of a 1N hydrochloric acid was added to the suspension to neutralize the alkalinity bringing the pH of the suspension to 7.0.

After neutralization as above, 7 g of methyl methacrylate monomer and 20 g of a 6% aqueous sulfurous acid were added to the suspension kept at 60° C. and agitation was further continued for additional 2 hours at the same temperature to effect polymerization of the monomer. After completion of the reaction, the mixture cooled to room temperature had a value of pH of 3.0.

A half portion of the thus obtained suspension was filtered as such and the wet cake was dried in vacuum to give a polymer-coated ferrite powder, which is called the unneutralized ferrite hereunder. The other half portion of the suspension was filtered after neutralization to a pH of 7.0 by adding a small volume of a 0.1N aqueous solution of sodium hydroxide and the wet cake was dried in vacuum to give a polymer-coated ferrite powder, which is called the neutralized ferrite hereunder. The polymer content in the polymer-coated ferrite powder was 6.5 g per 100 g of the ferrite.

The unneutralized and neutralized ferrites thus obtained were subjected to the test to examine the influences on the stability of the magnetic dynamites blended therewith by the Abel's heat test in the same manner as in the preceding examples. The times to the nitrogen dioxide detection were 30 minutes or longer and 22 minutes for the dynamites blended with the neutralized and unneutralized ferrites, respectively, immediately after the preparation of the magnetic dynamites. The Abel's heat test was repeated with the same magnetic dynamites after 6 months of storage to give the results that the times to the nitrogen dioxide detection were unchanged in the dynamite blended with the neutralized ferrite while the time was decreased to 18 minutes in the dynamite blended with the unneutralized ferrite.

EXAMPLES 12 TO 20

In each of the Examples here described, 100 g of a barium ferrite powder (except for Examples 12 and 16) or a strontium ferrite powder (Examples 12 and 16), each having an average particle diameter of about 1 μm, were suspended in 300 g (Example 15) or 500 g (except for Example 15) of water and the suspension was vigorously agitated for about 30 minutes at 80° C. After the end of the 30 minutes agitation, the pH of each of the suspensions was measured to give a value indicated in Table 1 below.

Then, into the suspension after neutralization to a pH of 7.0 by adding a small volume of a 1N sulfuric acid (Examples 15, 19 and 20) or a 1N hydrochloric acid (except for Examples 15, 19 and 20) and kept at a temperature indicated in the table were added 20 g of a 6% aqueous sulfurous acid and one or two kinds of the monomers as indicated in the table in amounts also indicated in the table and the polymerization of the monomer or monomers was conducted by agitating the suspension kept at the same temperature for 3 hours (Examples 15 and 16) or 2 hours (except for Examples 15 and 16). The value of pH of the cooled suspension was as given in the table.

A half portion of the thus obtained suspension was filtered as such and the wet cake was dried in vacuum to give a polymer-coated ferrite powder which is called the unneutralized ferrite hereunder. The other half portion of the suspension was neutralized to a pH of 7.0 by adding a small volume of a 0.1N aqueous solution of sodium hydroxide and filtered and the wet cake was dried in vacuum to give a polymer-coated ferrite powder, which is called the neutralized ferrtie hereunder. The contents of polymer in these polymer-coated ferrite powders were determined from the weight increase to give the values indicated in Table 1.

Each of the thus obtained polymer-coated ferrite powders was ground with a mortar and a pestle and subjected to the stability test of the dynamite blended therewith by the Abel's heat test in the same manner as in the preceding examples.

The time to the nitrogen dioxide detection was 30 minutes or longer in each of the dynamites as blended with the neutralized ferrites while the time was 25 minutes or less in the dynamites blended with the unneutralized ferrite as is shown in Table 1. The Abel's heat test was repeated with the same dynamite samples after storage of one month (Examples 17 to 20) or six months (Examples 12 to 16). No noticeable changes were noted in the time to the nitrogen dioxide detection in the magnetic dynamites blended with the neutralized ferrites while remarkable decreases were noted in the time in the magnetic dynamites blended with the unneutralized ferrites as is shown in Table 1.

TABLE 1

| Example No. | pH of suspension before neutralization | Polymerization: Monomer(s) (g, taken) | Polymerization: Temperature, °C. | pH of suspension after polymerization | Amount of polymer coating, g/100 g ferrite | Stability of magnetic dynamite with unneutralized ferrite, minutes: As prepared | Stability of magnetic dynamite with unneutralized ferrite, minutes: After storage |
|---|---|---|---|---|---|---|---|
| 12 | 10.5 | Methyl methacrylate (7) | 60 | 3.2 | 6.1 | 24 | 20[a] |
| 13 | 11.0 | Methyl acrylate (7) | 60 | 3.5 | 6.4 | 20 | 15[a] |
| 14 | 11.0 | Methyl methacrylate (3) | 60 | 3.1 | 2.5 | 22 | 15[a] |
| 15 | 11.5 | Methyl methacrylate (7) | 35 | 2.4 | 6.5 | 19 | 15[a] |
| 16 | 10.6 | Methyl acrylate (7) | 35 | 2.7 | 6.2 | 21 | 16[a] |
| 17 | 11.0 | Styrene (7) | 60 | 3.0 | 5.9 | 25 | 20[b] |
| 18 | 11.0 | Vinyl acetate (3) | 40 | 2.4 | 1.9 | 18 | 12[b] |
| 19 | 11.0 | Methyl methacrylate (7) Ethyleneglycol dimethacrylate (0.5) | 60 | 3.3 | 6.6 | 24 | 19[b] |
| 20 | 11.0 | Methyl acrylate (7) Ethylenegylcol dimethacrylate (0.35) | 60 | 2.9 | 6.7 | 20 | 14[b] |

[a]for 6 months,
[b]for 1 month

EXAMPLE 21

An aqueous suspension of 100 g of a barium ferrite powder having an average particle diameter of about 1 μm in 500 g of water was vigorously agitated for 30 minutes at 80° C. The value of pH of this suspension was 11.0. After being neutralized to a pH of 7.0 by adding a small volume of a 1 N hydrochloric acid, the suspension kept at 60° C. was admixed with 7 g of methyl methacrylate monomer and 20 g of a 6% aqueous sulfurous acid and the polymerization reaction of the monomer was conducted by agitating the suspension for 2 hours at 60° C. The value of pH of the suspension after completion of the polymerization reaction and cooling down to room temperature was 3.1.

A half portion of the suspension was filtered as such and the wet ferrite powder was dried in vacuum to give a polymer-coated barium ferrite powder, which is called the unneutralized ferrite hereunder. The other half portion of the suspension was filtered and the wet cake of the ferrite was washed six times each with 200 g of water and thereafter dried in vacuum. The value of pH of the washing water obtained in the last washing was 6.2. The thus washed and dried polymer-coated ferrite powder is called washed ferrite hereunder. The polymer content in these polymer-coated ferrite powders was 6.0 g per 100 g of the ferrite.

After grinding with a mortar and a pestle, each of the polymer-coated ferrites was subjected to the test for the influence on the stability of the magnetic dynamite blended therewith by the Abel's heat test in the same manner as in the preceding examples. The time to the nitrogen dioxide detection was 30 minutes or longer in the dynamite blended with the washed ferrite indicating substantially no adverse influences on the stability of the dynamite while the time in the dynamite blended with the unneutralized ferrite was 22 minutes. The tests were repeated with the same magnetic dynamites after six months of storage to find that the time to the nitrogen dioxide detection had decreased to 16 minutes in the magnetic dynamite blended with the unneutralized ferrite while the time was still 30 minutes or longer in the dynamite blended with the washed ferrite.

EXAMPLE 22

In the same apparatus as used in Example 1 were suspended 100 g of the same barium ferrite powder as in Example 1 in 500 ml of water and the suspension was vigorously agitated for 30 minutes at 80° C. The pH value of the suspension as cooled was 11.0. The suspension was neutralized by adding a small volume of a 1 N hydrochloric acid to a pH of 7.0 and filtered and the wet cake was dried in a vacuum desiccator and disintegrated by use of a mortar and a pestle.

The influence of the above obtained treated barium ferrite on the stability of a powdery ammonium nitrate explosive was examined by thoroughly blending 10 g of the barium ferrite powder with 100 g of the explosive and subjecting the thus ferrite-blended explosive to the test of free acid according to the testing procedure specified in Article 59 of the Regulations for Explosive Control. The time for reddening of a blue litmus paper according to the procedure was 8 hours or longer while this time for an acceptable explosive should be at least 4 hours.

For comparison, the same barium ferrite powder before the neutralization treatment was subjected to the same test for the stability of the ferrite-blended ammonium nitrate explosive. The time for the reddening of the blue litmus paper was about 3 hours.

EXAMPLE 23

The same strontium ferrite powder as used in Example 12 was suspended in water and agitated in the same manner as in Example 22. The pH of the suspension as cooled was 10.5. The suspension was neutralized to a pH of 7.0 by adding a small volume of a 1N sulfuric acid and filtered and the wet cake was dried and disintegrated as in the preceding example.

The influence of the thus neutralized strontium ferrite powder on the stability of a powdery ammonium perchlorate explosive was examined by blending 10 g of the ferrite powder with 100 g of the explosive and subjecting the ferrite-blended explosive to the test of free acid.

The time for reddening of the blue litmus paper was 8 hours or longer while the time in the test with the same strontium ferrite powder before the neutralization treatment was about 3 hours.

EXAMPLES 24 TO 29

Into an aqueous suspension of 100 g of the same barium ferrite or strontium ferrite as used in Example 22 or 23 at a pH of 7.0 by the neutralization with a 1N sulfuric acid (Example 26) or 1N hydrochloric acid (excepting Example 26) were added a monomer indicated in Table 2 below in an amount also given in the table and 20 g of a 6% aqueous sulfurous acid and the suspension was agitated at the temperature and for the time indicated in the table to effect the polymerization of the monomer. After completion of the reaction and cooling to room temperature, the pH of the suspension was determined to give the value given in the table.

A half portion of the thus obtained slurried mixture was filtered as such and the wet cake of the ferrite powder was dried in vacuum and disintegrated to give a polymer-coated ferrite powder, which is called the unneutralized ferrite hereinafter. The other half portion of the aqueous suspension was neutralized to a pH of 7.0 by adding a small volume of a 1N aqueous solution of sodium hydroxide and treated in the same manner as above to give another polymer-coated ferrite powder, which is called the neutralized ferrite hereinafter. The coating amount of each of the ferrite powders was determined from the weight increase to give the value given in the table.

Each of the thus obtained unneutralized and neutralized ferrites was subjected to the examination of the influences on the stability of the ammonium nitrate explosive or ammonium perchlorate explosive blended therewith by the free acid test of the ferrite-blended explosives in the same manner as in Example 22. The times for reddening of the blue litmus paper are shown in Table 2.

TABLE 2

| Example No. | Ferrite *1 | Polymerization: Monomer(s) (g, taken) | Polymerization: Temperature, °C. | Polymerization: Time, hours | pH of suspension after polymerization | Amount of polymer coating, g/100 g ferrite | Free acid test, hours to litmus reddening: Explosive *2 | Free acid test: Blended with neutralized ferrite | Free acid test: Blended with unneutralized ferrite |
|---|---|---|---|---|---|---|---|---|---|
| 24 | Ba | Methyl methacrylate (7) | 60 | 2 | 3.0 | 6.5 | (b) | >8 | 2 |
| 25 | Sr | Methyl acrylate (7) | 35 | 3 | 2.7 | 6.2 | (a) | >8 | 1.5 |
| 26 | Ba | Styrene (7) | 60 | 2 | 3.0 | 5.9 | (a) | >8 | 2 |
| 27 | Sr | Vinyl acetate (3) | 40 | 2 | 2.4 | 1.9 | (b) | >8 | 2 |
| 28 | Ba | Methyl acrylate (3) | 35 | 3 | 2.4 | 2.6 | (a) | >8 | 1.5 |
| 29 | Ba | Methyl methacrylate (7) Ethyleneglycol dimethacrylate (0.5) | 60 | 2 | 3.3 | 6.6 | (b) | >8 | 2.5 |

*1. Ba: barium ferrite; Sr: strontium ferrite
*2. (a): ammonium nitrate explosive; (b): ammonium perchlorate explosive

What is claimed is:

1. A magnetically traceable explosive which comprises (a) an explosive selected from the group consisting of nitric ester explosives, nitrate explosives and perchlorate explosives, and (b) magnetic ferrite powder particles dispersed throughout said explosive, each particle of said ferrite powder having a polymeric material coating thereon, wherein the polymeric material forming the coating on the ferrite particles is a polymer produced by the free radical polymerization of a monomer selected from the group consisting of acrylic and methacrylic acids and esters thereof, vinyl esters of aliphatic carboxylic acids, aromatic vinyl compounds, dienic monomers, acrylonitrile, methacrylonitrile, acrylamide, and methacrylamide, and combinations thereof, and the substrate surface of each particle within said coating being substantially chemically neutral, so that the explosive does not react with particles having defects in the polymeric material coating which permit the explosive to contact the substrate surface.

2. The magnetically traceable explosive according to claim 1 wherein the substrate surface of said particles is substantially free of alkalinity and acidity.

3. The magnetically traceable explosive of claim 1 wherein neutrality of said substrate surface is such that when uncoated particles are mixed with water, the water attains a pH in the range from 5.0 to 9.0.

4. The magnetically traceable explosive as claimed in claim 1 wherein the monomer is selected from the group consisting of acrylic and methacrylic acids and esters thereof selected from among methyl acrylate, butyl acrylate, ethyleneglycol dimethacrylate, and 2-hydroxyethyl methacrylate, vinyl esters of aliphatic carboxylic acids including vinyl acetate, and vinyl propionate, aromatic vinyl compounds including styrene, and α-methylstyrene, and dienic monomers including butadiene, isoprene, and chloroprene, and acrylonitrile, methacrylonitrile, acrylamide and methacrylamide, and combinations thereof.

5. The magnetically traceable explosives as claimed in claim 1 wherein the amount of the polymeric material forming the coating on the ferrite particles is in the range from 0.5 to 10% by weight based on the ferrite powder.

* * * * *